United States Patent [19]

Soligno

[11] 4,371,035

[45] Feb. 1, 1983

[54] TUBE SUPPORT GRID

[76] Inventor: Vincenzo Soligno, Via Volturno, 9, 27058 - Voghera, Italy

[21] Appl. No.: 39,680

[22] Filed: May 16, 1979

[30] Foreign Application Priority Data

May 17, 1978 [IT] Italy ..... 23511 A/78

[51] Int. Cl.[3] ..... F28F 9/18

[52] U.S. Cl. ..... 165/162; 122/510; 376/405

[58] Field of Search ..... 122/510; 165/162

[56] References Cited

U.S. PATENT DOCUMENTS 4,021,204 5/1977 Straffi ..... 165/162
4,213,499 7/1980 Straffi ..... 165/162

FOREIGN PATENT DOCUMENTS 1022410 of 0000 Canada .
2263056 of 0000 Fed. Rep. of Germany .
2541986 of 0000 Fed. Rep. of Germany .
2756592 of 0000 Fed. Rep. of Germany .
2169313 of 0000 France .
2223650 of 0000 France .
2373770 of 0000 France .

OTHER PUBLICATIONS

Article entitled "Case Histories in Failure Analysis", first published in Praktische Metallographie", Number 14, 1977.

*Primary Examiner*—Samuel Scott
*Assistant Examiner*—Theophil W. Streule, Jr.
*Attorney, Agent, or Firm*—Fleit & Jacobson

[57] ABSTRACT

A supporting grid for tubes comprising a central reticular structure formed of main and secondary intersecting strips, an inner annular frame formed in the same material as the strips and so designed as to receive with a tight fit the ends of said strip therein, said inner frame being higher than the reticular structure so that upper and lower projecting portions are created together with cleaning ducts, and an external annular frame formed of a different material and consisting of an external box ring and of an external cover ring capable of receiving and containing therein said projecting portions of the inner frame, axially extending and inwardly facing dogs being provided at the inner portion of said external frame; the inner frame and the external frame being assembled so that at room temperature said dogs of the external frame fit tightly to the inner cylindrical surface of said projecting portions while play exists between the external cylindrical surface of the inner frame and the internal cylindrical surface of the external frame for free thermal expansion of the two materials.

8 Claims, 13 Drawing Figures

TUBE SUPPORT GRID

BACKGROUND OF THE INVENTION

This invention relates to a grid for supporting tubes in steam generators, heat exchangers and the like. In conventional apparatus, as steam generators for use, for example, in a P.W.R. reactor system, conventional tube plates, welded tube grid supports and more recent tube grid supports with mechanical fitting joints (produced with grooves in the strip ends) are used to receive the tubes or pipes and to support them during the assembling of the tube bundle in said steam generator and during the operating time.

The application of such prior art tube supports has caused sometimes assembling and operating problems, such as fretting and denting between the tubes and the tube support (as in the case of tube plate in carbon steel) and fretting between the strip ends and the external frame (as in the case of grid supports), with the consequent production in that region of corrosion products, such as magnetite, that may attack the integrity of the tubes and of the support and therefore may substantially reduce the reliability and the security of the apparatus.

The present invention is directed to a solution of such problems and has as a general objective the provision of a novel tube grid support, wherein the supported tubes, the support grid and particularly the mechanical fitting joints between the strip ends and the peripheral frame structure have increased rigidity and are not subjected to chemical, mechanical and/or thermic stresses during the assembling and/or the operating time. A further object of the present invention is to provide a tube grid support, which is economical to manufacture, rigid in construction, rigid during the assembling in the apparatus, during the transportation and erection of the apparatus at the site, elastic in operation and reliable for long operating time.

SUMMARY OF THE INVENTION

The present invention provides a new support grid for tubes in two differents materials, comprising a central reticular structure, formed for example of stainless steel strips, and a peripheral inner annular frame, formed in the same material as the recticular structure, for example stainless steel, containing the strip ends and being higher than said reticular structure so as two projecting portions are fomed; and an external annular frame formed in a different material and consisting of an external box ring and of a cover ring capable of receiving and containing therein said projecting portions of the inner frame, axially extended and inwardly facing dogs being provided at the inner portion of said external frame; the inner frame and the external frame being assembled so that at room temperature said dogs of the external frame fit tightly to the inner cylindrical surface of said projecting portions while play exists between the external cylindrical surface of the inner frame and the internal cylindrical surface of the external frame.

The support grid structure produced in accordance with the invention is particularly suitable for supporting the tubes in apparatus such as steam generators, for example nuclear steam generators of P.W.R. Reactors, heat exchangers and the like.

Between the reticular structure and the peripheral inner annular frame is provided a substantially tight mechanical fit, while between the peripheral inner annular frame containing the strip ends and the external frame structure is provided a sliding mechanical fit, with play for free differential thermic expansion between the two different materials.

The central reticular structure is formed of a lower and an upper set of main and secondary strips, equally spaced, intersecting each other by means of milled slots in the main strips, the strips fitting together in the manner of combs.

The inner annular frame is formed in a single piece provided with milled slots so as to receive the strip ends or it may comprise an independent intermediate frame ring, thereto being rigidly connected, by means of pins and/or by welds, a lower and an upper set of block-like spacers forming slots between one another so as to receive the ends of said lower and upper strips respectively, said intermediate annular frame ring being tight connected to the lower and upper main strip ends.

The external annular frame is formed of a lower L-shaped box frame ring and an upper L-shaped cover frame ring rigidly fixed together and having internal annular dogs axially extending, inwardly facing and overlapping an external annular portion of the reticular structure, said annular dogs fitting, in the manner of a free thermic expansion joint, the conjugate internal cylindrical surfaces of the peripheral inner frame, said cylindrical surfaces projecting on both sides, with respect the upper and lower surfaces of the reticular structure.

With reference particularly to the use of the supporting grid for tubes in the nuclear steam generators of P.W.R. reactors, wherein flow velocities, temperatures and fluid pressures are all of a high order, the type of grid in accordance with the invention has the following advantages as compared to the conventional welded joints or to more recent conventional mechanical joints produced with fitting grooves into the ends of the strips:

(a) increased mechanical strength of the joint, high reliability and consequent long duration of the same. In fact the strip ends have in every point of the contacting area with the adjacent spacers the full cross section corresponding to the total height of the strip end. Moreover the strip ends are not subjected to the forces produced by the fluid circulation or by boiling. In fact, the radial forces in the supporting grid due to the transverse hydraulic excitation of the tubes caused by the cross-flow of the feed water or of the recirculated water will be transmitted by the reticular structure directly to the inner annular frame. Also the axial forces on the supporting grid due to the flow of the feed water or of the recirculated water parallel to and along the supported tubes and therefore perpendicular to the plane of the supporting grid will be transmitted directly from the reticular structure to the internal annular dogs of the external frame rings of the support.

(b) Absence or considerable reduction of the formation of build-up corrosion products in the contact zone between the two materials during the operating time. The new design concept of the new joint, that is the proper selection of the materials and the proper geometry of the joint, minimizes considerably the potential for the concentration of corrosion products in that area. This could prevent the free expansion of the circular grid structure and could damage the joint. In fact the strip ends and the contacted adjacent spacers are both of the same material, for example of stainless steel. Moreover there is no relative movement and therefore no fretting between the ends of the main supporting strips of the reticular grid structure and the adjacent spacers, fixed rigidly to the independent intermediate frame ring since said ring, said spacers and said main strip being fitted tight therebetween and having a substantially equal thermic expansion coefficient, will expand and contract together at the same rate under varying temperature.

If fretting between the above mentioned spacers in stainless steel and the facing overlying flange rings of the external framework in carbon steel will cause the formation of some magnetite corrosion products these will be removed, as hereinafter described, by throughing water through the numerous axial interspaced cleaning holes provided in the upper and lower parts of the external frame, through the substantial play provided between the stainless steel inner frame and the carbon steel external frame and through the cleaning ducts provided in the projecting portions of the inner frame.

(c) Precision in achieving a more correct geometry of the circular grid structure, that is centered without play on the external box shaped annular frame during the assembly operation, only mechanical and very few not deforming welding operations being involved during the manufacture.

(d) Assembly of the complete supporting grid at one time, that is no moving of the circular grid structure, in partial assembled condition, for a subsequent machining and after again moving for the final assembly.

All component parts are prepared and arranged properly on a template before the final assembly at one time, thus reducing considerably the total time and therefore the total cost for the manufacture and assembling of the complete supporting grid.

(e) More precision in the alignment of several tube support grids of the type described having the same geometrical configuration and a more rigid structure particularly in the external frame in carbon steel.

(f) More facility and speed in inserting the pipes in the tube places.

(g) Elimination of damage to the tubes during the inserting operation and/or during operation, caused by fretting and/or denting between the tubes and the supports in carbon steel and/or of less precision such as those of tube plate type or of grid type having welded joints or mechanical joints produced with fitting grooves in the strip ends.

BRIEF DESCRIPTION OF THE DRAWINGS

The objects and the advantages of the present invention will become apparent as the description process with the aid of the accompanying drawings, which show a typical but not limiting solution of a preferred embodiment and of an alternate embodiment of the supporting grid.

DESCRIPTION OF THE PREFERRED EMBODIMENT

Figure 1:
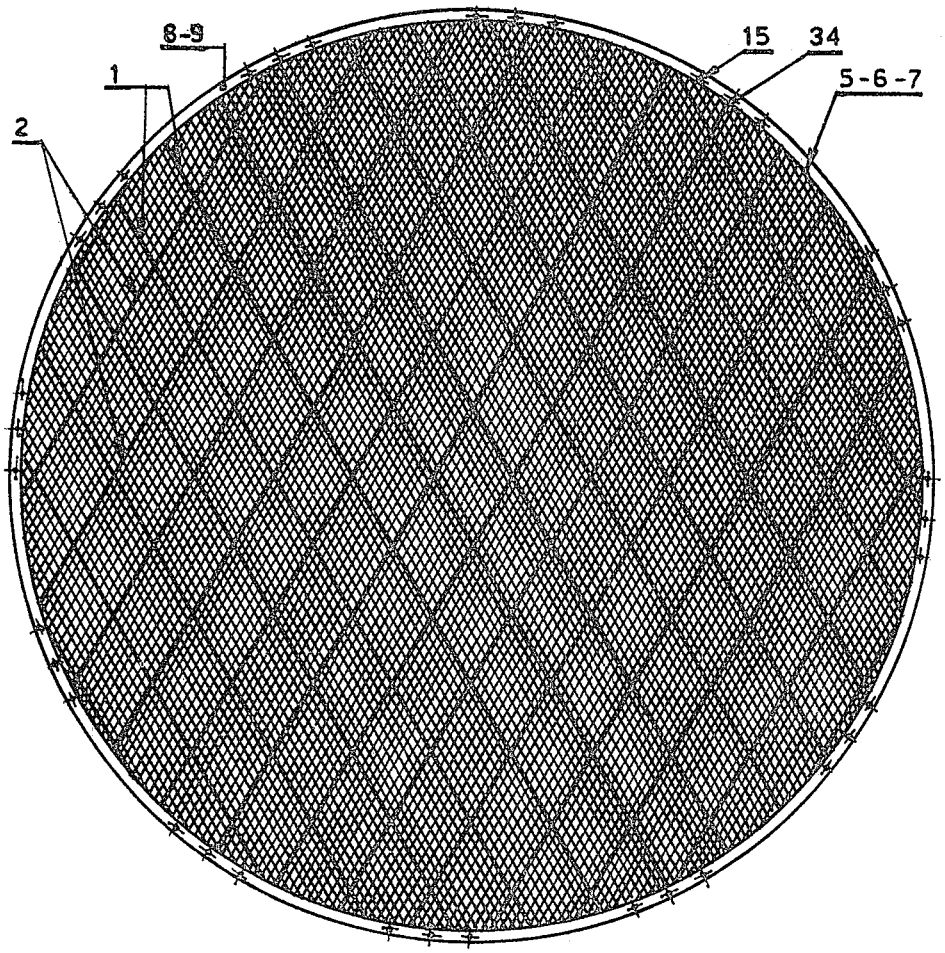
FIG. 1 represents schematically the support grid in a plan view.
Figure 2:
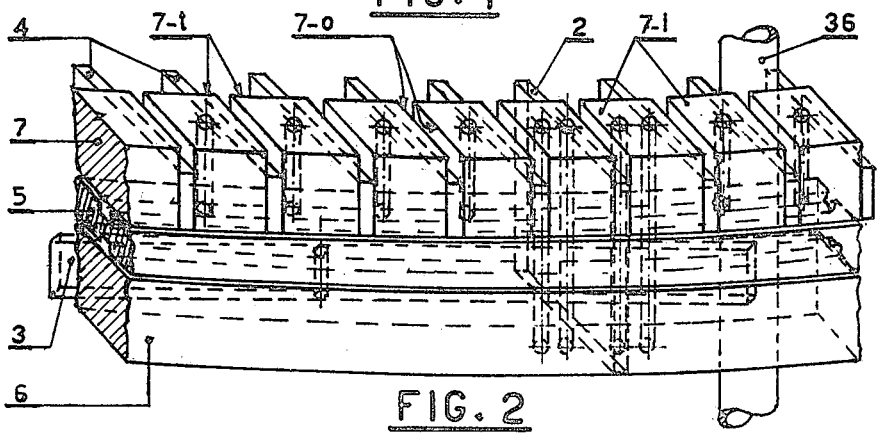
FIG. 2 represents in a larger scale a portion of the preferred embodiment of the circular grid structure of the support in a perspective view.
Figure 4:
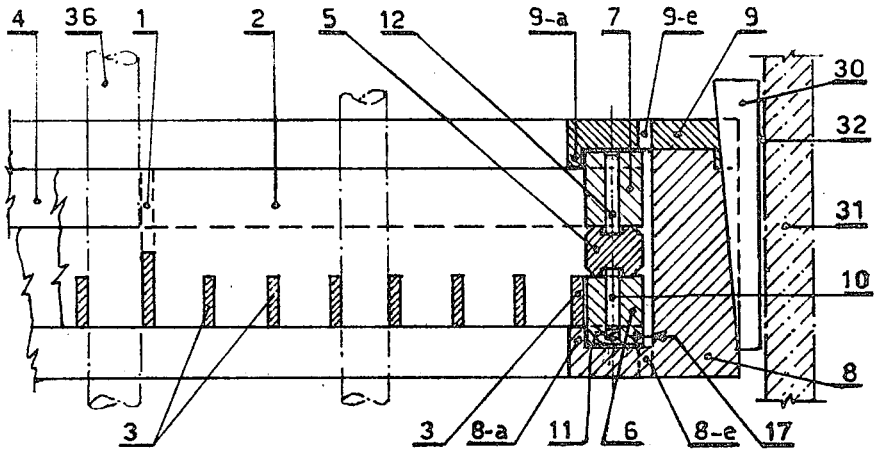
FIG. 4 represents in a larger scale a portion of the preferred embodiment of the support in cross-section along the line IV—IV of the plan view of FIG. 3.
Figure 3:
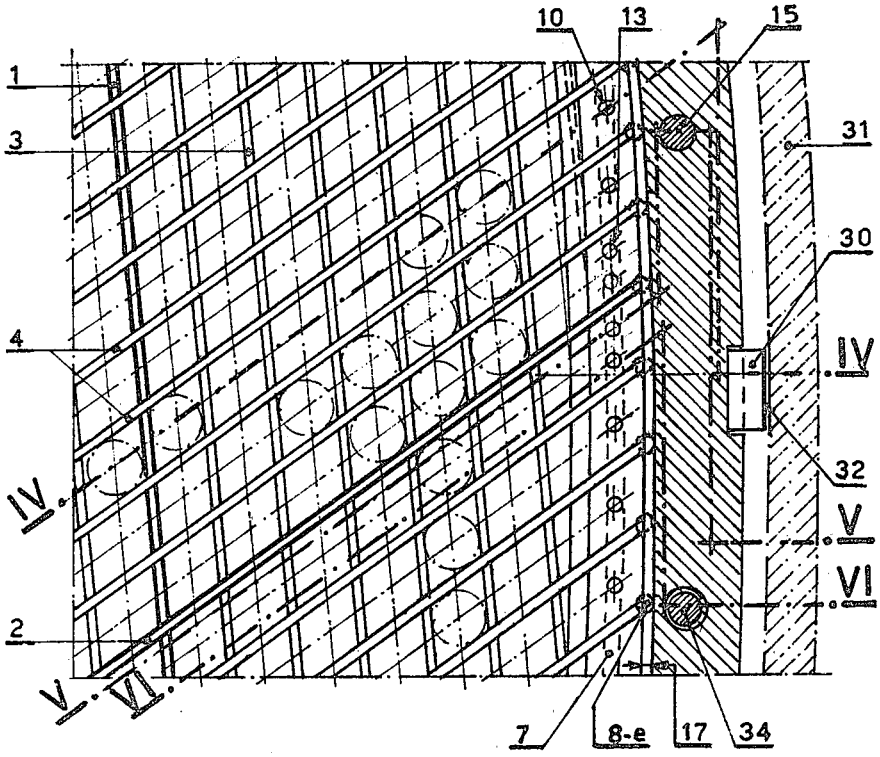
FIG. 3 represents in a larger scale a portion of the preferred embodiment of the support in a partial plan view.
Figure 5:
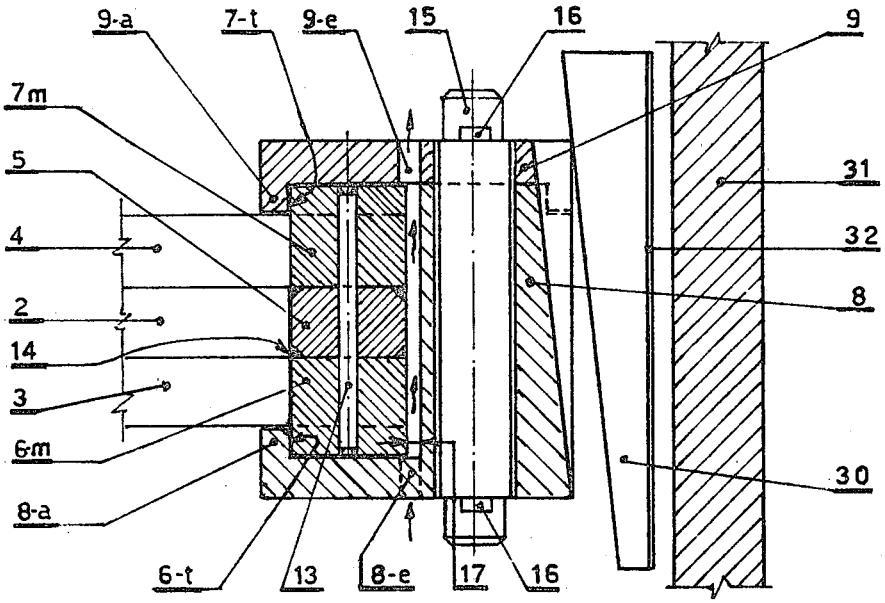
FIG. 5 represents in a larger scale a portion of the preferred embodiment of the support in cross-section along the line V—V of the plan view of FIG. 3 (when the support is at room temperature).
Figure 11:
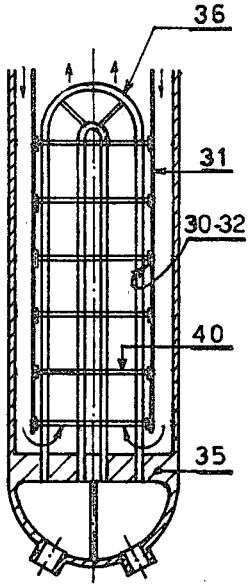
FIG. 11 represents schematically a partial view of a nuclear steam generator of P.W.R. reactors in a typical cross-section.

As represented in the drawings FIG. 1–10 and FIG. 7*a* (the last FIG. 7*a* will be taken as reference only for the external frame rings and for the strips) the preferred embodiment of the support grid, of the template used for the assembling of the support grid and of the assembling of the same in a typical steam generator, consists of the following components:

For the support grid:

lower main strips 1 in stainless steel; upper main strips 2 in stainless steel; lower secondary strips 3 in stainless steel; upper secondary strips 4 in stainless steel; intermediate spacer ring 5 in stainless steel; lower secondary spacer 6 adjacent to the secondary strip ends, in stainless steel; lower main spacers 6*m* adjacent to the main strip ends in stainless steel; upper secondary spacers 7 adjacent to the secondary strip ends, in stainless steel; upper main spacers 7*m* adjacent to the main strip ends, in stainless steel; lower external box ring 8 in carbon steel; upper external cover ring 9 in carbon steel; lower retainer pins 10 in stainless steel between the lower secondary spacers 6 and the spacer ring 5; lower springs 11 underlying the retainer pin 10; upper retainer pins 12 in stainless steel between the upper secondary spacers 7 and the spacer ring 5; long joining pins 13 in stainless steel interconnecting the lower main spacers 6*m*, the spacer ring 5 and the upper main spacers *7m;* joining welds 14 in stainless steel between the main spacers *6m–7m* and the spacer ring 5; joining pins 15 in carbon steel between the lower external box ring 8 and the upper external cover ring 9; joining welds 16 in carbon steel between the joining pins 15 and the external rings 8–9;

For the template used for the assembling of the support grid:

main template 20; auxiliary template ring segments 21 for the positioning of lower secondary spacers 6; auxiliary template ring segment 22 for the positioning of the upper secondary spacers 7; calibrated stakes 23 with threaded ends for the positioning of the main strips 1–2 and of the secondary strips 3–4 and for the fixing of the auxiliary template ring segments 22; joining screws 24 between the ring segments 21 and the template 20; supporting wedges 25 for supporting the ring segment 21 during the assembling of the support grid; supports 26 for supporting temporarily the external box ring 8 during the assembling of the support grid; mounting screws 27 for lifting and supporting the external box ring 8 during its assembling on the inner frame formed of intermediate ring 5 and spacers 6–7;

For the assembling of the grid in the steam generator represented in FIG. 11:

wedges 30 for the alignment and for the fixing of the grid to the casing 31; spacer 32 of proper adhesive between the casing 31 and the wedge 30; spacer tube 33 between two facing grid supports for the axial positioning of the grids in the steam generator; through bolts 34 for the axial fixing of a plurality of support grids 40 to the tube sheet 35 of the steam generator.

The mutual position of the component part surfaces of the grid support at cold temperature (room temperature) and at high temperature (the parts expanded at the operating temperature have the same reference number of the same parts at room temperature with the added index <'>, as for example 5' and 5, *6m'* and *6m*) is specified hereinafter, with reference to the above mentioned drawings and assuming that the conjugate surfaces have the same reference letter index, as for example 3-o and 6-o, 4-o and 7-o; it would be noted that the play or offset 17 and 18, shown in FIGS. 3, 4, 5, 6 and *6a* has been exagerated for purposes of illustration; this play 17 has been provided to allow the stainless steel circular grid structure to expand radially during periods of normal and high thermal activity, relative to the slower thermal expanding external frame in carbon steel of the support:

(a) conjugate surfaces in surface-to-surface contact only at cold temperature:

external cylindrical dog surface 8-t of the lower external box frame ring 8 and the internal generally cylindrical surfaces 6-t of the outer projecting portion of the lower spacers 6, *6m;* external cylindrical surfaces 9-t of the internal dog 9-a of the upper external cover frame ring 9 and the internal generally cylindrical surfaces 7-t of the outer projecting portion of the upper spacers 7, *7m.;*

(b) Conjugate surfaces in surface-to-surface contact or facing each other with the substantially small play therebetween only at operating temperature (the plan 17 is reduced to said substantially small play 17'):

external generally cylindrical surfaces 6-s of the lower spacers 6, *6m* and the internal cylindrical box surface 8-s of the lower external box frame ring 8; external cylindrical surface 5-s of the independent intermediate frame ring 5 and the internal cylindrical box surface 8-s of the lower external box frame ring 8; external generally cylindrical surfaces 7-s of the upper spacers 7, *7m* and the internal cylindrical box surface 8-s of the lower external box frame ring 8;

(c) Conjugate surfaces facing each other with a substantially small play therebetween at cold and high temperature:

internal annular dog surface 8-p of the lower external box frame ring 8 and the external annular reticular portion surface formed of the lower strip end portion surfaces 1-p and 3-p of the lower strips 1, 3 respectively; internal annular dog surface 9-p of the internal dog 9-a of the upper external cover ring 9 and the external annular reticular portion surface formed of the upper strip end portion surfaces 2-p and 4-p of the upper strip 2 and 4 respectively;

(d) Conjugate surfaces in surface-to-surface contact at cold and high temperature or facing each other with a substantially small play therebetween at high temperature, as the case of a thin layer of metal adhesive therebetween being melted at high temperature as hereinafter described or as the case of a small difference of the thermic expansion coefficient of the fitting materials:

axially and generally radially extending surfaces 6-o of the lower spacers 6, *6m* and the strip end surfaces 1-o, 3-0 of the lower strips 1, 3 respectively; axially and generally radially extending surfaces 7-0 of the upper spacers *7m*, 7 and the strip end surfaces 2-0, 4-0 of the upper strips 2, 4 respectively; upper strip end surfaces 1-r, 3-r of the lower strip end 1, 3 respectively and the lower annular surface 5-r of the independent intermediate frame ring 5; lower strip end surfaces 2-v, 4-v of the upper strip 2, 4 respectively and the upper annular surface 5-v of the independent intermediate frame ring 5; axially and generally tangential extending end surfaces 1-c of the lower main strip 1 and the internal cylindrical surface 5-c of the independent intermediate frame ring 5 (this ring assuming position 5 at cold temperature, FIG. 5, and position 5' shown in dotted line at operating temperature, FIG. 6); axially and generally tangential extending strip end surfaces 2-c of the upper main strip 2 and the internal cylindrical surface 5-c of the independent intermediate frame ring 5 (this ring assuming two different positions as above described); external lower annular flange surface 9-c of the upper external cover frame ring 9 and the upper external annular flange surface 8-c of the lower external box frame ring 8 (said surfaces being always in surface-to-surface contact both at room and operating temperatures); internal cylindrical surface 9-u of the external dog 9-b of the upper external cover frame ring 9 and the upper external cylindrical surface 8-u of the lower external box frame ring 8 (said surfaces being generally in surface-to-surface contact both at room and operating temperature); upper internal annular flange surface 8-i of the lower external box frame ring 8 and the lower annular surface 6-i of the lower spacers 6, *6m* (said surfaces having generally a substantially small play therebetween at operating temperature); internal lower annular flange surface 9-i of the external cover frame ring 9 and the upper annular surface 7-i of the upper spacers 7, *7m* (said surfaces having generally a substantially small play at operating temperature).

It should be noted that the external generally cylindrical surfaces 1-s, 2-s, 3-s, 4-s, 5-s, of the strip ends 1, 2, 3, 4 and independent intermediate frame ring 5 respectively, are generally aligned to each other both at room and operating temperatures, that is all said surfaces are always positioned on an unique envelopping cylindrical surface.

As shown in the drawings and as well known, the milled slots of the main strips are equally mutually spaced and are of two kinds:

main slots—with a depth equal to half of the width of the strip, for the coupling of the main strips 1, 2 to one another;

secondary slots—with a depth equal to ⅓ of the width of the strip able to receive the secondary strips 3, 4.

The assembling of the individual strips, which will then form the grid, is carried out on a horizontal plane of a template 20 with the aid of an assembly jig. At each main crossing, this jig has stakes 23 assuring the position of each intersection for all main strips. A normal grid of this type comprises, for example, two dozen main or carrying strips and eight secondary strips for each main strip, the finished grid having a diameter of about 3 m.

The lower main strips 1 are first placed on the assembly template 20; at the bottom such strips terminate with a L-end l-o covering piece 6-m at the conjugate surface 6-o thereof.

Now piece 5 in stainless steel is assembled, piece 5 being a continuous ring rigidly joined to the main spacers 6-m and 7-m (by means like through pins 13 and/or by welds 4), whereupon and between the adjacent main spacers 7-m the upper main strips 2 are assembled, these strips also having a L-end 2-0 downwards facing that is the end thereof is such to cover piece 7-m, at the conjugate surface thereof 7-0.

Finally the lower and the upper secondary strips 3 and 4 are assembled, that is the upper surfaces 3-r and the lower surfaces 4-v of the ends thereof respectively contact the conjugate annular surface 5-r and 5-v respectively of the intermediate frame ring 5.

Between the adjacent strip end surfaces 3-o of each pair of secondary lower strips 3 a lower secondary spacer block 6 is inserted; in the axial extending blind hole 6-z thereof has been previously assembled a spring 11 and thereupon a pin 10, so that the spacer 6 is fixed by the pushing out of the pin 10 in the groove 5-v of the ring 5 under the action of said spring 11, when said spacer 6 has been pushed in its definitive position under the ring 5 and stopped by the auxiliary assembly ring segment 21. Also between the adjacent strip end surfaces 4-o of each pair of the secondary upper strips 4 an upper secondary spacer block 7 is now inserted and stopped by the auxiliary assembly ring segment 22, thereafter the pin 12 is inserted in the axial extending through hole 7-z of the spacer 7 and in the groove 5-x of the frame ring 5.

The surfaces of mutual contact between the ends of the strips 1, 2, 3, 4 and spacers 6, 6-m and 7, 7-m, as well the surfaces 5-r, 5-v of ring 5 contacting the spacers, have been previously prepared for receiving a layer of metal paste or glue (for example, base and reactor polymerizing under cold or slightly warm condition) of hot water soluble type, or eventually soluble with other solvents. This paste or glue completely locks the parts of the grid together forming a rigid inner frame.

The auxiliary assembly ring segments 21 and 22 are successively dismounted and the external frame rings 8 and 9, the surfaces 8-i and 9-i thereof and/or the conjugate surfaces 6-i and 7-i respectively being previously covered with a layer of said metal paste or glue, are at least assembled and interconnected by means of welded bolts or pins 15.

Figure 6:
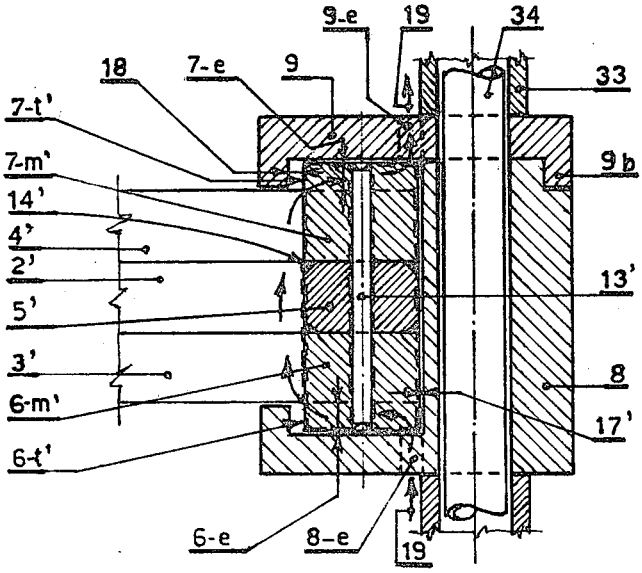
FIG. 6 represents in a larger scale a portion of the preferred embodiment of the support in cross-section along the line VI—VI of the plan view of FIG. 3 (when the supports is at operating temperature, for example at 250° to 350° C.).
Figure 5A:
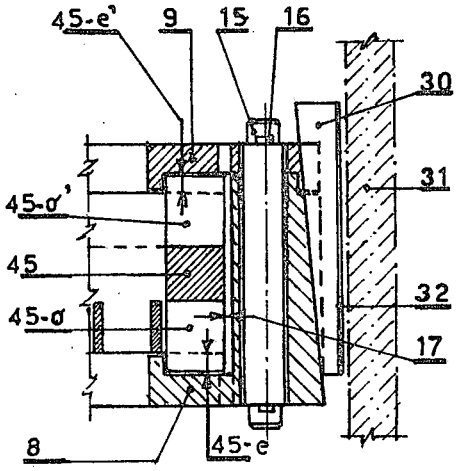
FIG. 5*a* represents in a larger scale a portion of an alternate embodiment of the support in a modified cross-section along the line V—V of the plan view of FIG. 3 (support at room temperature).
Figure 6A:
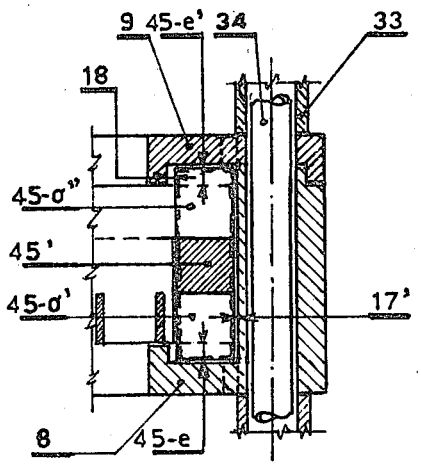
FIG. 6*a* represents in a larger scale a portion of said alternate embodiment of the support in a modified cross-section along the line VI—VI of the plan view of FIG. 3 (support at operating temperature).

When the generator is set in operation, the flow of water and saturated steam, for example at a temperature of 150°-200° C., melts the glue or paste and the strips and the intermediate framework are free to expand, that is strips 1, 2, 3 and 4 of stainless steel, the independent frame ring 5 interengaged with spacers 6, 6-m and 7, 7-m also in stainless steel slide together at substantially same rate with little or no relative thermal expansion, the required clearances being provided, thus the said last mentioned parts assuming the position 5', 6-m', 7-m' as shown in the drawing FIG. 6. Thus the external frame components, that is pieces 8, 9, which are of carbon steel, may expand freely to a lesser extent.

The mutual position of the lower and upper dogs 8-a and 9-a of the box frame ring and cover frame ring respectively with the conjugate lower and upper spacer surfaces 6-t and 7-t respectively is such that at room temperature the outer surfaces 8-t and 9-t of the dogs 8-a and 9-a respectively contact rigidly the inner conjugate surfaces 6-t and 7-t of the spacers, as shown in the drawing, while at operating temperature, for example 300° C., between said outer cylindrical surfaces 8-t and 9-t of the dogs 8-a and 9-a respectively and the inner conjugate cylindrical surfaces 6-t and 7-t of the lower and upper spacers respectively is sufficient play 18 to allow flow of the hot water 19 through the lower and upper set of the radial cleaning ducts 6-e and 7-e respectively, between the adjacent spacers, overlying the strip ends, and through the axially extending interspaced holes 8-e, 9-e, formed through the external frame ring annular region facing the play 17 between said external frame rings and the inner frame.

Also the glue layer 32 applied on the external surface of the wedges 30 inserted about the grid will unglue and leave a free clearance equal to the thickness of the previously inserted glue or paste. This enables a free axial sliding between the pack of grids maintained spaced apart from one another by spacers 33 made of stainless steel and the casing 31 of carbon steel. It should be noted that said dogs 8-a and 9-a on the external frame serve also the purpose of retaining the spacers, when unglued, during operation, in the case of breakage of the interconnecting pins 10 and 12.

DESCRIPTION OF AN ALTERNATE EMBODIMENT

An alternate embodiment of the support grid is represented in the drawings FIG. *5a*–*6a* and *7a*. Most of the component parts shown in these drawings are the same represented in the drawings FIG. 1–10 and therefore bear the same reference number.

The unique difference to be noted in the above mentioned drawings is the different embodiment of the inner frame, that consists of a single intermediate spacer ring 45 in stainless steel having a height equal to the sum of the partial height of lower spacer 6 or 6-m, intermediate spacer ring 5 and upper spacer 7 or 7-m represented in the FIG. 1–10, said single ring 45 having a set of lower milled teeth 45-o generally radially extending and a set of upper milled teeth 45-o' also generally radially extending, both sets of teeth provided to receive in the space-like slot between adjacent teeth the ends 1-o, 3-o and 2-o, 4-o of the lower and upper strips respectively.

Figure 7A:
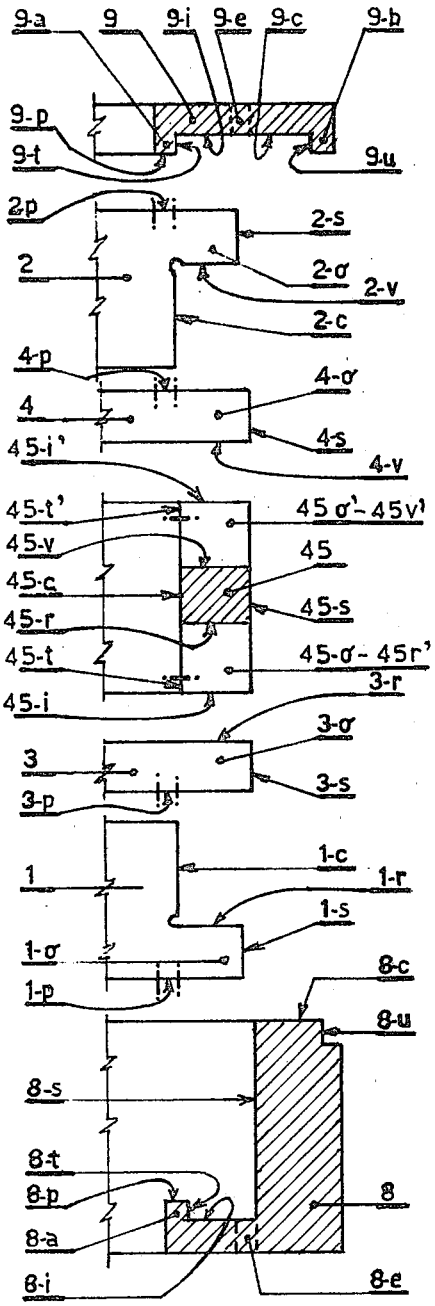
FIG. 7*a* represents in a larger scale and in an exploded cross-section the component parts of an alternate embodiment of the peripheral inner frame of the circular grid structure, of the strips and of the external frame rings, said strips and rings being the same for the preferred and for the alternate embodiments of the grid support.
Figure 7:
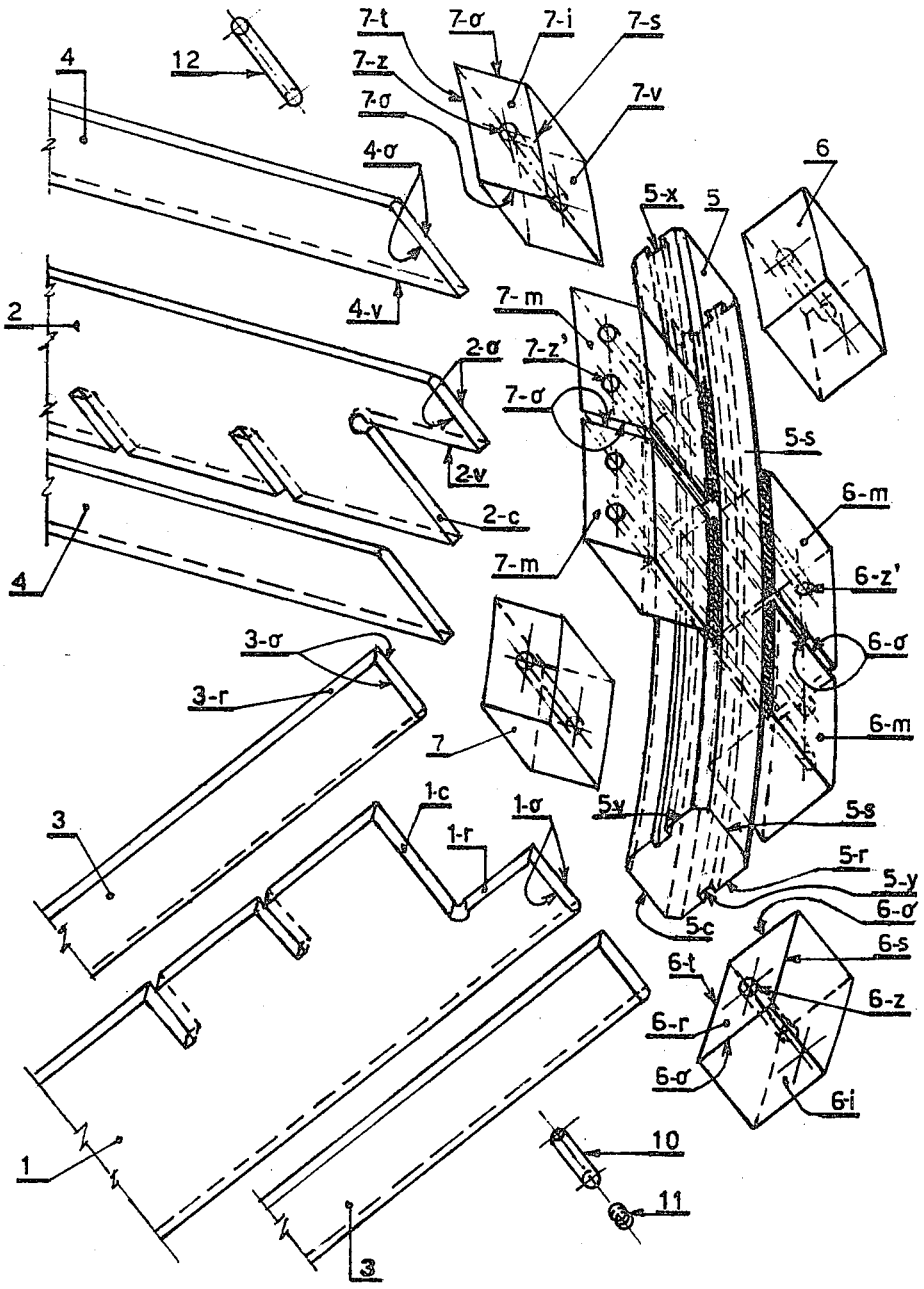
FIG. 7 represents the component parts of the preferred embodiment of the circular grid structure of the support in an exploded perspective view.

For this alternate embodiment of the support grid the mutual position of the component part surfaces will be the same as above described for the preferred embodiment, assuming that the lower teeth 45-0 and the upper teeth 45-o' of FIG. *7a* perform the same functions as the lower and upper spacers 6, 6-m and 7, 7-m of FIG. 7 respectively and the conjugate contacting surfaces thereof with the outer cylindrical surfaces 8-t and 9-t of the dogs 8-a and 9-a respectively are the tooth inner lower and upper cylindrical surfaces 45-t and 45-t' respectively, so also as the contacting conjugate surfaces of said teeth with the annular flange surfaces 8-i and 9-i are the lower and the upper tooth annular surfaces 45-i and 45-i' respectively.

The material described above for the preferred and the alternate embodiment of the grid support may also be substituted by equivalent material and for each pair of said different materials for the circular grid structure and for the outer box frame there will be suitable play therebetween to allow free differential thermic expansion in the area of the joint. In the case in which the materials are equal there may be no play, but it is nevertheless suitable that a minimum amount of play be provided to allow the free thermic expansion of the components of the pipe bearer due to the inevitable uneveness in the temperature of the same.

DESCRIPTION OF THE PREFERRED EMBODIMENT OF THE TEMPLATE FOR THE FINAL ASSEMBLING OF THE ABOVE DESCRIBED SUPPORTING GRID

Figure 8:
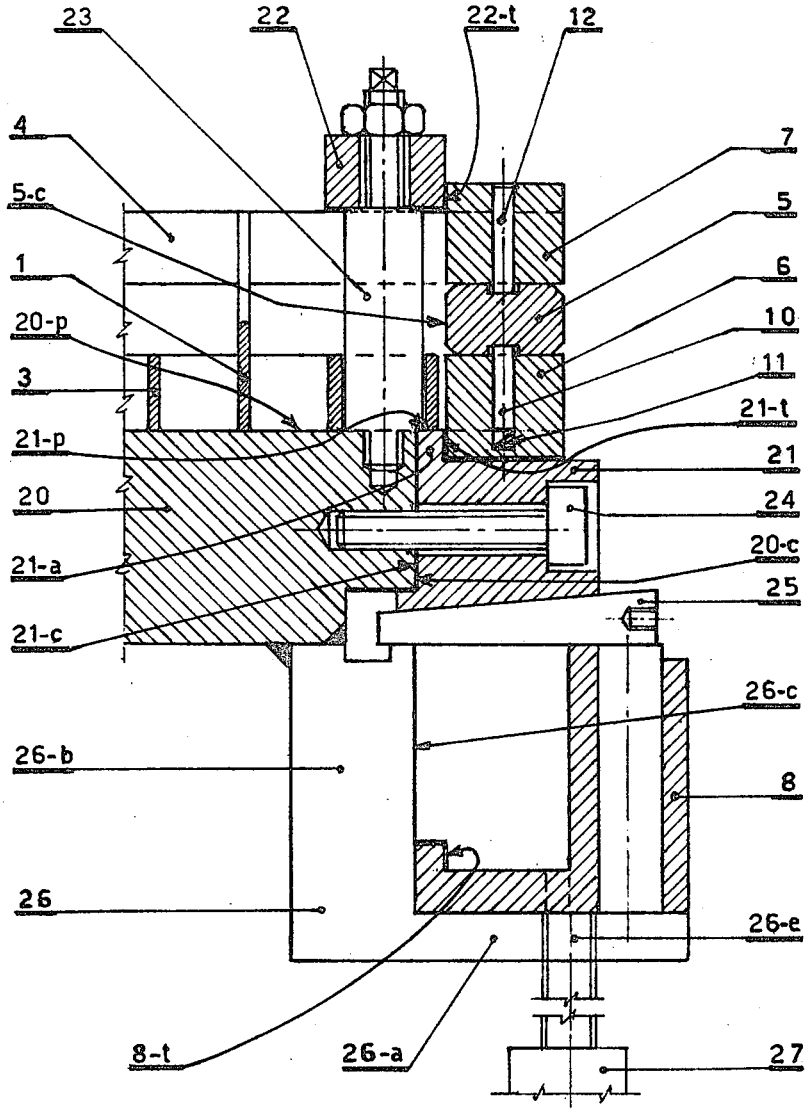
FIG. 8 represents in a larger scale a portion of the preferred embodiment of the grid support and of the template used for the final assembling in a typical cross-section.
Figure 9:
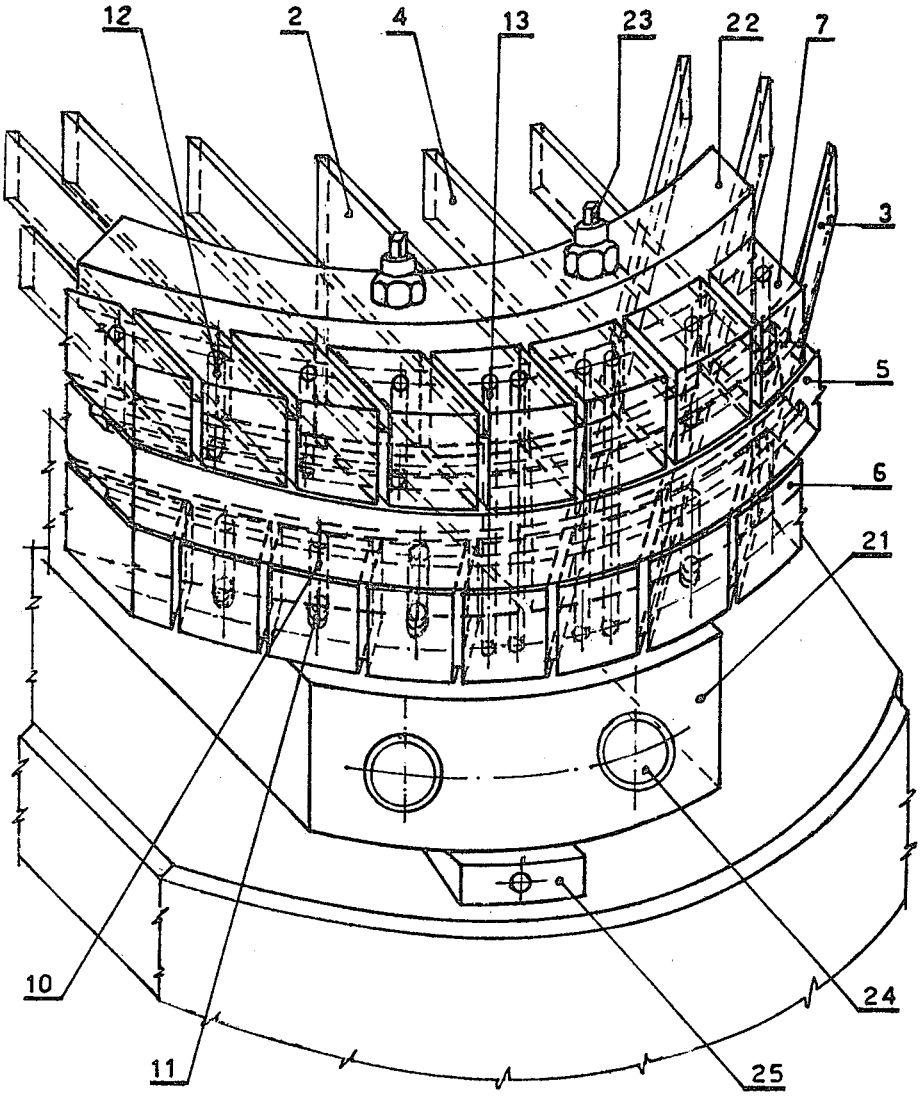
FIG. 9 represents in a larger scale a portion of the preferred embodiment of the grid support and of the template used for the final assembling in a perspective view.
Figure 10:
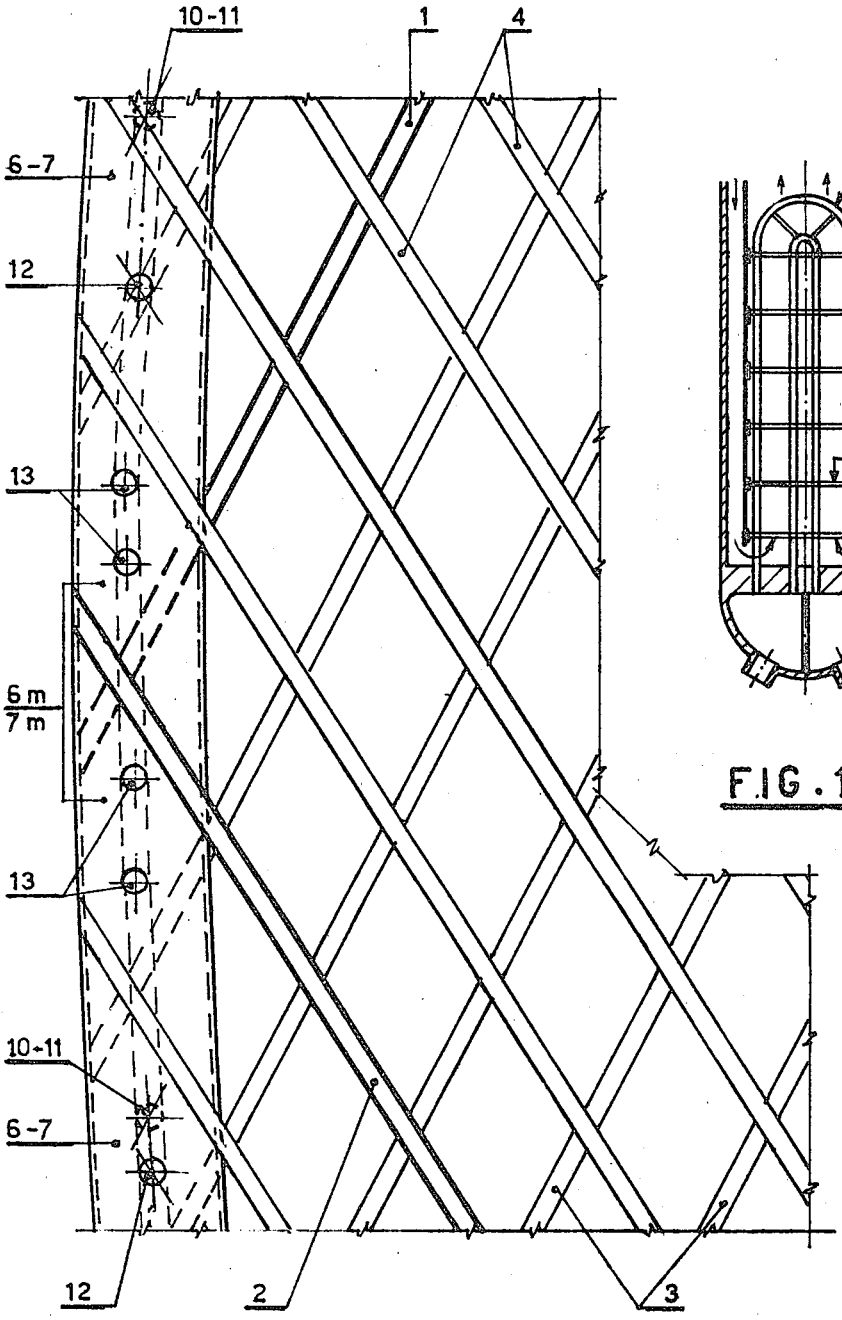
FIG. 10 represents in a real scale a portion of the preferred embodiment of the circular grid structure in a partial plan view (for example for a grid support having a 3 m. outside diameter).

As represented in the drawing FIG. 8; a template for the final assembling of the finished component parts of the supporting grid is comprising:

(a) an horizontal rigid cylindrical main template 20 having rigidly connected, by welding, at the peripheric annular lower surface thereof, shaped interspaced support legs 26, the external cylindrical surface 26-c of the inner axially extending portion 26-b thereof being aligned with the external cylindrical surface 20-c of said main template 20, the annular radially extending portion 26-a of said L-shaped support legs 26 being provided to support temporarily the lower external box frame ring 8 of the supporting grid, during the final assembling thereof, and incorporating threaded interspaced through axial holes 26-e provided to receive the mating lifting screws 27 for lifting said lower external box frame ring 8 along the said external cylindrical surface 26-c of said support legs 26 and successively along said external cylindrical surface 20-c of said main template 20.

(b) auxiliary template ring segments 21, the inner cylindrical surface thereof 21-c being tight interconnected with the conjugate external cylindrical surface 20-c of said main template 20, by the fixing screws 24, said auxiliary ring segments 21 having an internal annular dog 21-a axially extending, the upper radially extending annular surface thereof 21-p being aligned with the horizontal upper surface 20-p of said main template 20, the external cylindrical surface 21-t of said ring segment dog 21-a being aligned with the inner cylindrical surface 5-c of said intermediate frame ring 5, said dog 21-a having an axial height 21-t equal to the height of the internal annular dog 8-t of the said external lower box frame ring 8 and being provided to allow the exact radial positioning of the inner frame assembly 5, 6, 7 or 45, 45-o, 45-o' on said auxiliary template ring segments 21 for purpose of successively dismounting said template ring segments 21, previously having dismounted the underlying conjugate supporting wedges 25 (disposed between said ring segments 21 and said external lower box frame ring 8) and the conjugate fixing screws 24, and successively assembling of said external lower box frame ring 8 on said intermediate frame-work assembly 5, 6, 7 or 45, 45-o, 45-o' by operating said lifting screws 27.

(c) auxiliary template ring segments 22 supported and fixed on calibrated stakes 23, said stakes axially extending, peripherally interspaced and screwed to said main template 20, said ring segments 22 having the external cylindrical surface 22-t aligned with the internal cylindrical surface 5-c of said intermediate frame ring 5 and being provided to allow the exact radial positioning of said intermediate framework assembly 5, 6, 7 or 45, 45-o, 45-o '.

Assembly of the alternate embodiment is carried out as above described. In this case however the inner frame consists only of the single ring 45 so that no spacers are inserted.

I claim:

1. For use in a steam generator, heat exchanger and the like having a plurality of tubes located within a casing, a supporting grid for tubes comprising:

a. a central reticular structure for supporting the tubes formed of a first material and consisting of a lower and an upper set of equally spaced main intersecting strips having inter-engaging main milled slots at the intersecting zones and equally spaced secondary milled slots therebetween, and a lower and an upper set of equally spaced secondary strips located in said secondary milled slots, said lower and upper main strips terminating with L-shaped ends inwardly facing each other respectively;

b. an inner annular frame of the same first material capable of receiving with a tight fit the ends of said strips and being higher than the reticular structure so that upper and lower projecting portions are created together with cleaning ducts;

c. an external annular frame connectable to the casing and formed of a second material and consisting of an external lower box ring and of an external upper cover ring capable of receiving and containing therein said projecting portions of the inner frame, axially extending and inwardly facing dogs being provided at the inner portion of said external frame; the inner frame and the external frame being assembled so that at room temperature said dogs of the external frame fit tightly to the inner cylindrical surface of said projecting portions while play exists between the external cylindrical surface of the inner frame and the internal cylindrical surface of the external frame for free thermal expansion of the two materials.

2. A supporting grid as in claim 1 wherein the inner angular frame consists of a single ring provided with an upper and lower set of milled slots, generally radially extending, capable of receiving the ends of the strips, the upper portion of the upper slots and the lower portion of the lower slots forming cleaning ducts.

3. A supporting grid as in claim 1 wherein the inner annular frame is formed of a lower and an upper set of block-like spacers positioned between the ends of adjacent strips to fill the peripheral space therebetween, said spacers having opposed, generally radially extending surfaces, an intermediate annular ring placed between said upper and lower spacer and between said upper and lower strip ends, and fixing means to secure rigidly to said intermediate annular frame ring said lower and upper spacers.

4. A supporting grid as in claim 1, wherein the external frame is provided with the upper and lower cleaning holes axially extending and provided near the play existing between the external cylindrical surface of the inner frame and the internal cylindrical surface of the external frame.

5. Supporting grid as in claim 3 wherein said lower spacers have generally at least one axially extending through hole provided to receive a fixing pin or one axially extending blind hole provided to receive a retainer pin and an underlying spring, said upper spacers having generally at least one axially extending through hole provided to receive a fixing pin or a retainer pin; said pins penetrating in holes and/or grooves provided in said intermediate ring.

6. Supporting grid as in claim 3, wherein said fixing means to secure rigidly the spacers to said intermediate annular ring are welds used together or not with pins.

7. Supporting grid as in claim 1, wherein said external cover frame ring terminates externally with another annular dog axially extending fitting tight to a cylindrical conjugate surface of an L-shaped notch provided in the external upper part of the external lower box frame ring.

8. Supporting grid for tubes in a casing for use in a steam generator heat exchanger and other similar apparatus, comprising:

a central reticular structure for supporting tubes comprised of a first material and being formed of a plurality of lower (1) and upper (2) equally spaced main intersecting strips being provided with inter-engaging main milled slots at the intersecting zones and with equally spaced secondary milled slots therebetween, said structure also comprising a plurality of lower (3) and upper (4) secondary strips which are housed in said secondary slots, said main lower (1) and upper (2) strips terminating with opposed L-shaped ends (1*c*,1*r*,2*c*,2*v*);

a peripheral structure connectable to the casing comprised of two parts: an inner annular frame (5,6,7; 45) capable of receiving the strip ends of an outer annular frame consisting of two opposed L-shaped rings (8,9) capable of receiving said inner frame and blocking, at room temperature, said reticular structure by means of annular dogs (8*a*,9*a*) which are provided in the inner zone of said outer annular frame, said dogs extending axially and being directed towards the inside of the structure;

said inner annular frame (5,6,7; 45) being formed of the same first material as said strips and being capable of receiving the ends of said strips (1,2,3,4);

said inner annular frame being higher than the central reticular structure, thus forming, at both ends, projecting portions (6-t, 45-t, 7-t, 45-t'), together with cleaning ducts therebetween (6*e*, 45*e*; 7*e*, 45-e');

said outer annular frame being formed of a second material and having an outer lower box-ring (8) and an outer upper cap-ring (9), said rings being capable of receiving and containing said projecting portions (6-t, 45-t, 7-t, 45-t') of said inner annular frame (5,6,7; 45), thus blocking, at room temperature, said reticular structure through said projecting portions; and said outer rings (8,9) being assembled to said inner annular frame (5,6,7; 45) so that, at room temperature, said annular dogs (8*a*,9*a*) of said outer rings (8,9) are assembled to the inner cylindrical surfaces of said projecting portions (6-t, 45-t, 7-t, 45-t') of said inner annular frame, while there is a play (17) between the outer cylindrical surface (6-s, 5-s, 7-s; 45-s) of said inner annular frame and the inner cylindrical surface (8-s) of the outer annular frame in order to allow the free thermic expansion of the two materials.

* * * * *